US006371430B1

(12) United States Patent
Vernackt

(10) Patent No.: US 6,371,430 B1
(45) Date of Patent: Apr. 16, 2002

(54) AUTOMATICALLY ADAPTING VACUUM HOLDER

(75) Inventor: Marc Vernackt, Overmere (BE)

(73) Assignee: Mania Barco N.V., Zwijnaarde (BE)

( * ) Notice: Subject to any disclaimer, the term of this patent is extended or adjusted under 35 U.S.C. 154(b) by 0 days.

(21) Appl. No.: 09/447,184

(22) Filed: Nov. 22, 1999

(51) Int. Cl.[7] ..... A45D 42/14; B65H 5/02
(52) U.S. Cl. ..... 248/362; 248/363; 271/276
(58) Field of Search ..... 248/205.5, 683, 248/362, 363; 271/276, 196, 195

(56) References Cited

U.S. PATENT DOCUMENTS

| | | | | |
|---|---|---|---|---|
| 4,145,040 A | | 3/1979 | Huber | 271/276 |
| 4,202,542 A | | 5/1980 | Lammers et al. | 271/276 |
| 5,183,252 A | | 2/1993 | Wolber et al. | 271/276 |
| 5,374,021 A | | 12/1994 | Kleinman | 248/362 |
| 5,383,001 A | | 1/1995 | Bosy | 355/73 |
| 5,716,048 A | | 2/1998 | Morrissette | 271/276 |
| 5,758,874 A | | 6/1998 | Morrissette | 271/276 |
| 5,772,170 A | * | 6/1998 | Tsukushi | 248/363 |
| 5,836,224 A | | 11/1998 | Gerber | 83/22 |
| 5,865,433 A | | 2/1999 | Morrissette | 271/276 |
| 6,182,956 B1 | * | 2/2001 | McMillan | 269/21 |
| 6,209,867 B1 | * | 4/2001 | Madsen et al. | 271/276 |

* cited by examiner

*Primary Examiner*—Anita King
(74) *Attorney, Agent, or Firm*—Dov Rosenfeld; Inventek

(57) ABSTRACT

This invention relates to a vacuum holder for securing workpieces, such as flexible media or printed circuit boards, through a suction force. Pressure responsive, one way flow valves are incorporated between chambers under suction openings to control the application of suction. This results in a restraining force that is uniform in time and space, resulting in a vacuum holder that has reduced pumping requirements.

27 Claims, 11 Drawing Sheets

AUTOMATICALLY ADAPTING VACUUM HOLDER

FIELD OF THE INVENTION

This invention generally relates to vacuum surfaces, such as drums, plates, or surfaces of other configurations, which use suction to secure a workpiece or flexible media positioned over suction openings located on the vacuum surface, and more particularly to configurations that allow the vacuum surface to respond to the shape and placement of the workpiece by providing suction only suction openings under or near the workpiece to the vacuum. The invention further relates to the use of vacuum surfaces used to secure printed circuit boards during the manufacturing thereof.

BACKGROUND

Vacuum tables, vacuum plates and vacuum drums, collectively referred to herein as "vacuum holders," are workpiece holding and restraining devices having a vacuum surface. A common approach for manufacturing such a vacuum holder is to have many suction openings terminating at a vacuum surface. The application of a vacuum produces a pressure difference across the workpiece, which it turn imparts a suction force on the workpiece towards the vacuum surface. The position, size and shape of the suction openings relative to the workpiece determine the required amount of vacuum and the suction force per workpiece area.

The uses for vacuum holders include a variety of industrial and commercial applications that require locating, restraining or transporting pieces. For vacuum plates and tables, workpieces are commonly positioned on the plate and the suction force is then engaged. Vacuum plates are used, for example, to transport a printed circuit board (PCB) from a stack to a direct imaging exposure device such as the exposure device described in co-assigned U.S. patent application Ser. No. 60/107,842. Vacuum drums are commonly configured as rotating cylindrical surfaces and are used for transporting flexible media, such as film and paper. Vacuum holders are used to position, secure and transport paper or film for scanning or printing/exposing. Paper processing and printing machines, for example, use vacuum holders to transport film or paper from one part of the machine to another. Other machines, such as imagesetters, laser printers and rotary data scanning and recording devices, use vacuum drums to support flexible media during exposure or scanning. In these devices the drum rotates with the suction engaged. Suction attaches the media to the drum at the point of first contact with open suction openings, and then pulls the media around the drum as it rotates.

All vacuum holders with vacuum surfaces incorporate a series of channels and suction openings in the vacuum plate or drum, allowing for one or a few vacuum connections to provide suction over an area of the surface. In many early and some contemporary prior art systems, the internal vacuum plumbing is configured so that suction is applied to all suction openings simultaneously. Another approach for manufacturing vacuum holders is to use a "porous" surface instead of suction openings. Regardless of the approach taken, there is a balance between the flow restriction of the surface and the vacuum source. A large suction force over a large area usually requires a low restricted porous material with a high capacity vacuum source.

There are several problems inherent in prior art configurations that result in a vacuum pumping requirement larger than the minimum needed to secure the workpiece. Consider the operation of a vacuum plate in which the workpiece is placed on the surface, covering some of the suction openings. Uncovered suction openings have a constant pumping requirement, and thus there will always be an excess capacity whose amount is determined by the minimum workpiece size. Covered suction openings will have a large pumping requirement until a vacuum seal between the workpiece and surface is formed, at which time the pumping requirement diminishes, theoretically approaching zero for a perfect vacuum seal. The pumping requirement will decreased from an initial value which must accommodate all of the covered suction openings, to nearly zero as a vacuum seal is formed. Thus it is seen that prior art vacuum holders require vacuum pumps that are oversized relative to the minimum capacity needed to restrain the workpiece.

Similar problems also occur in vacuum drum applications. The drum first makes contact with and picks up the leading edge of a flexible media. As the drum rotates, the media wraps about the dram and is held in place at the point of contact with the drum. In this application, the number of uncovered suction openings, and hence the pumping requirement, decreases as the rotation proceeds and suction openings are covered. The vacuum system must be capable of accommodating all of the initially uncovered suction openings.

Having several suction openings not covered by the workpiece may also produce undesirable noise and vibration.

Thus the application of suction simultaneously to all of suction openings on the vacuum surface produces several problems in earlier prior art systems. These can be characterized as requiring vacuum pumping overcapacity due to 1) uncovered suction openings, and 2) exposing all covered suction openings simultaneously. The problems due to uncovered suction openings has been previously acknowledged but only partially addressed in several U.S. Patents. Thus in U.S. Pat. No. 5,716,048, Morrisette describes a drum mask placed over the drum, where the mask is configured to cover those suction openings not covered by the media. This solution effectively tailors the vacuum drum to a media size as determined by the available masks. As noted in Morrisette, a mask must be produced for every media size, and the operator or machinery involved must adapt to changes in media size by changing masks. While that invention improves the performance by lowering the pumping requirement for each media size due to changes in the number of covered suction openings, this prior art invention requires intervention by either the operator or some machinery to choose the appropriate mask size. Furthermore, the suction force may be different for different masks because the area kept uncovered and number of free suction openings may differ.

Both U.S. Pat. Nos. 5,183,252 and 4,202,542 describe various methods for allowing vacuum drums to accommodate a few different media sizes through valving mechanisms that applying vacuum to pre-selected patterns of suction openings. These solutions do not require the additional mask hardware required by Morrisette, but do require complex, externally switchable vacuum plumbing if many different media sizes are to be accommodated. As with Morrisette, these references must also incorporate means to detect the size or orientation of the media. Each of these prior art solutions adapts the vacuum drum to a predetermined number of media sizes and orientations, and thus is not easily adaptable to sizes, shapes or orientations not considered in the initial machine design. In addition, none of the prior art addresses the excess pumping requirement due to applying suction to all of the suction openings simultaneously.

U.S. Pat. No. 5,374,021 to Kleinman includes a vacuum chamber which is divided into several sub-chambers each connected via a control passageway to one or more suction openings on a vacuum surface. Each control passageway includes a valve which is biased to keep the passageway open, and configured to close when the sub-chambers openings are not covered by a workpiece and a vacuum is applied to the vacuum sub-chambers. The valves of the passageways to openings that are covered by a workpiece remain open so that a vacuum is applied to hold the workpiece. The Kleinman system thus in effect provides a "self adapting mask" comprised of all the valves that are of the passageways to openings that are not covered by the workpiece. This offers advantages over the Morrisette and systems of U.S. Pat. Nos. 5,183,252 and 4,202,542 in that the Kleinman system adapts to all sizes, shapes or orientations.

The Kleinman system, however, still has several shortcomings. In addition, none of the prior art addresses the excess pumping requirement due to applying suction to all of the suction openings simultaneously.

This aspect of the present invention provides the benefit of limiting stresses on fragile workpieces.

SUMMARY OF THE INVENTION

An object of the present invention is providing a vacuum holder to restrain a workpiece with minimum or close to minimum vacuum pumping requirement.

Another feature of the present invention is providing a vacuum holder that can automatically adapt to a large number of workpiece sizes and orientations, using the same minimum or close to minimum vacuum pump requirement.

Yet another feature of the present invention is providing a vacuum holder that provides suction primarily to those suction openings covered by a workpiece.

Yet another feature of the present invention is providing a vacuum holder that can operate with a nearly constant, unregulated vacuum pumping requirement, independent of the workpiece size. Yet another feature of the present invention is providing a vacuum holder that is less bulky and less expensive as a result of decreased vacuum pumping requirements.

Yet another feature of the present invention is providing an adaptable vacuum holder that is both inexpensive and easily assembled.

Another feature of the present invention is the ability to reduce the stress and deformation of the workpiece through the slow, directional application of vacuum to the workpiece surface.

Another feature of the present invention is that it provides for holding media of different sizes with the same initial suction condition.

These and other features are provided for in an automatically adapting vacuum holder for supporting a workpiece through the application of a vacuum from a vacuum source, this vacuum holder comprising (a) a base having a workpiece support surface adapted for supporting a workpiece thereon, and (b) a vacuum plumbing system connected to the vacuum source through at least one vacuum port. The plumbing system includes (i) a plurality of chambers positioned along one or more directed lines of connection emanating from the vacuum port, each line of connection including a chamber directly coupled to one or more associated vacuum ports, (ii) a plurality of passageways positioned between any two chambers along any line of connection for controllably connecting each chamber along a line of connection to the next chamber further from the vacuum source along the line of connection, each passageway having a connected state and a disconnected state substantially connecting and substantially not connecting, respectively, the two chambers on either side thereof, and (iii) a plurality of vacuum bores each extending from the surface to a chamber to define a suction opening on the surface and configured to be substantially covered when a workpiece is placed thereon. Each chamber is either directly connected to the vacuum source or capable of being connected to the vacuum source via the passageways along a line of connection from the vacuum source. Each of the passageways from any particular chamber to the next chamber along any of the particular chamber's lines of connection is biased to be in the disconnected state to the next chamber along any of the particular chamber's lines of connection when the vacuum is not applied. Each of the passageways also is configured to remain in the disconnected state to the next chamber along any of the particular chamber's lines of connection if the suction opening of the vacuum bore of the particular chamber is not covered by the workpiece. Each of the passageways also is configured to be in the connect state to the next chamber along any of the particular chamber's lines of connection when the vacuum is applied and when the workpiece is placed on the surface so that the workpiece substantially covers the suction opening of the particular chamber and all the suction openings of the chambers closer to the vacuum source along any of the particular chamber's line of connection. In this way, the vacuum holder supports the workpiece and limits the number of uncovered suction openings to which the vacuum source is coupled by sequentially opening suction openings along the lines of communication, thus automatically regulating the amount of vacuum necessary to restrain the workpiece.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Figure 1A:
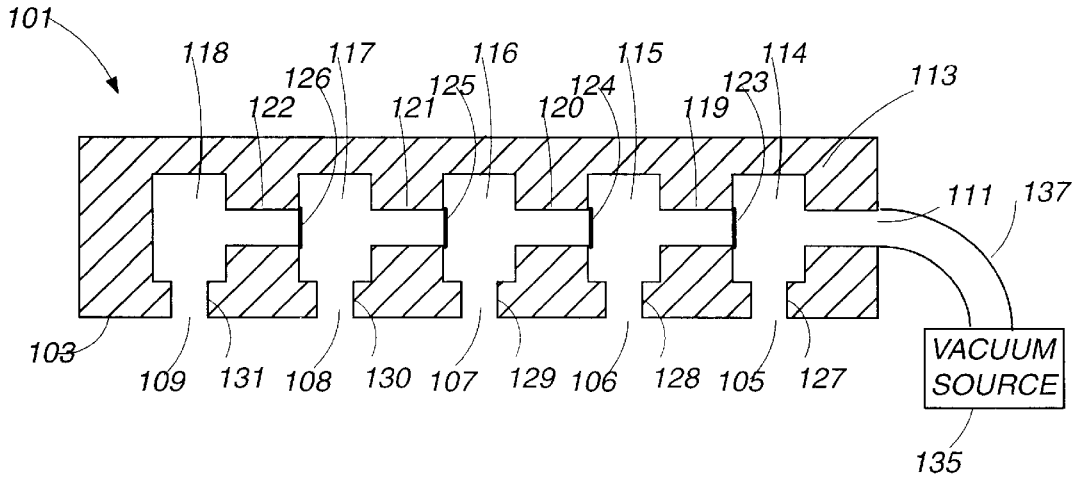
FIG. 1A is a cross-sectional schematic of the operation of an adaptable vacuum holder.

The Preferred Embodiment of the Adaptable Vacuum Holder Concept

A schematic illustration of the construction and operation of the present invention is shown in FIG. 1. An adaptable vacuum surface 101 comprises a workpiece support surface 103 which may be a planar or cylindrical surface, or in general any surface capable of supporting a workpiece 133 (shown in FIGS. 1B–1E) through a suction force at a plurality of suction openings 105 to 109 located on surface 103. A plumbing system 113 is capable of communicating vacuum from a conventional vacuum source 135 attached via a vacuum tube 137 and vacuum port 111 to suction openings 105 to 109. Plumbing system 113 comprises a series chambers 114 to 118 with interconnecting channels 119 to 122, flow valves 123 to 126 between adjacent chambers, and vacuum bores 127 to 131 connecting each chamber 114 to 118 to workpiece support surface 103. The valves can be either in a closed state, shown schematically by valves 123 to 126 in FIG. 1A, or in an open state, shown schematically by valves 123 to 125 in FIG. 1E. Thus each interconnecting channel and valve combination forms a passageway between chambers that can be controlled to be connecting or not connecting adjacent chambers along a line of connection. Closed valves prohibit the flow of ambient air external into vacuum surface 101 towards the vacuum source. Open valves that are adjacent to port 111 or form an unbroken chain of open valves leading to port 111 will draw ambient air into the vacuum system, providing suction at the appropriately associated suction openings. The application of suction is thus limited to a sequence of openings connected through open valves to the vacuum source.

Note that while FIG. 1 shows each chamber connected via a single vacuum bore to form a single suction opening, alternate embodiments may include a set more than one bores extending from each chamber to the surface 103 to define a set of more than one openings for each chamber. The embodiments described herein are all shown and described with one suction openings per chamber, and how to extend to having several suctions openings from each chamber would be straightforward to those in the art.

Adaptive Operation of the Present Invention

The active response of the present invention to the application of vacuum will now be considered in reference to FIGS. 1B–1E. As depicted in FIG. 1A, valves 123 to 126 are configured to be in a normally closed state in response to small pressure differences across each valve. Prior to the application of a vacuum at port 111, for example using vacuum source 135 connected to port 111 via vacuum tube 137, the pressure in each chamber, and hence on either side of each valve, is equal to the ambient pressure external to mechanism 101. The application of vacuum at port 111 results in an evacuation of chamber 114. FIG. 1A shows the response of vacuum support 101 in the case where there is no workpiece on surface 103. In this case suction opening 105 is unobstructed, and ambient air flows through suction opening 105 and bore 127 into chamber 114, and finally through port 111. As a result of pressure variations through plumbing system 113, the pressure in chamber 114 will be slightly less than ambient, as determined by the characteristics of bore 127 and suction opening 105. Valve 123 is configured to remain in a closed state by not opening in response to the slightly depressed pressure in chamber 114. Suction will be applied at suction opening 105 but not to any other suction openings, since valve 123 prevents communication of vacuum to the rest of plumbing system 113. Thus the response to the present invention to the application of vacuum without a workpiece is to restrict suction to suction opening 105 closest to port 111.

Figure 1B:
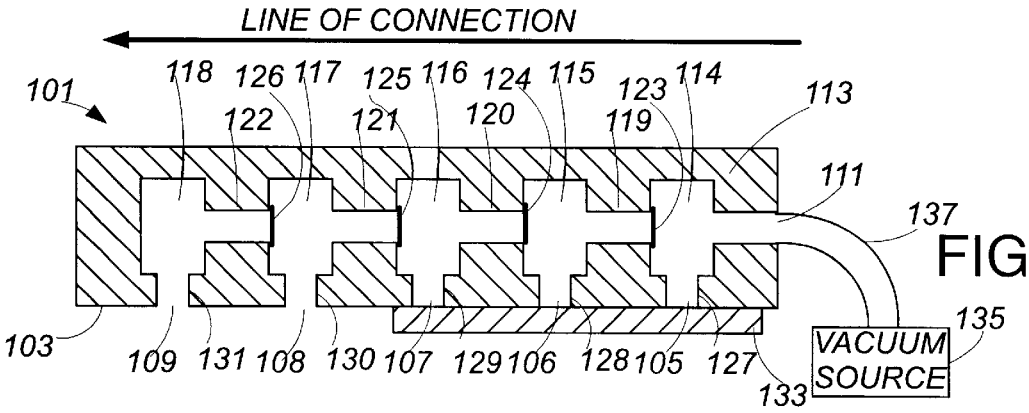
FIGS. 1B–1E are a series of cross-sectional schematics showing the operation of an adaptable vacuum holder with a workpiece in place.
Figure 1C:
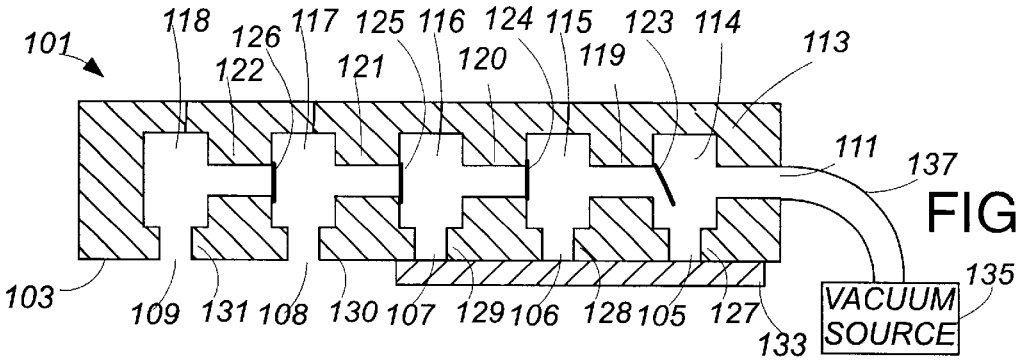
Figure 1D:
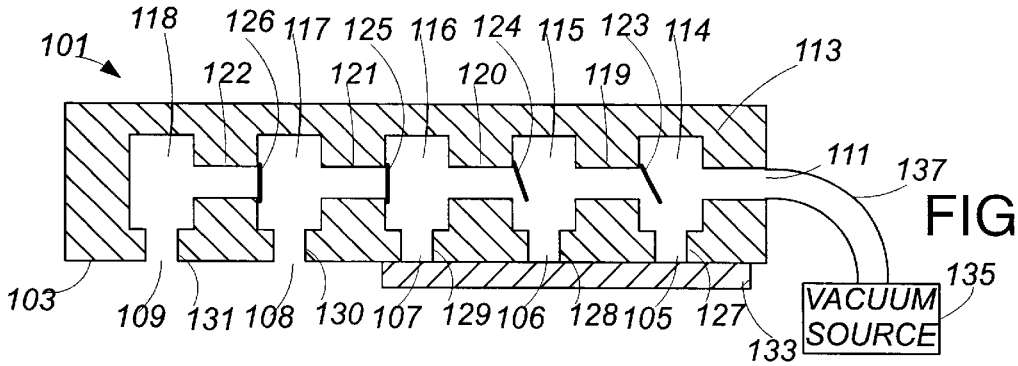
Figure 1E:
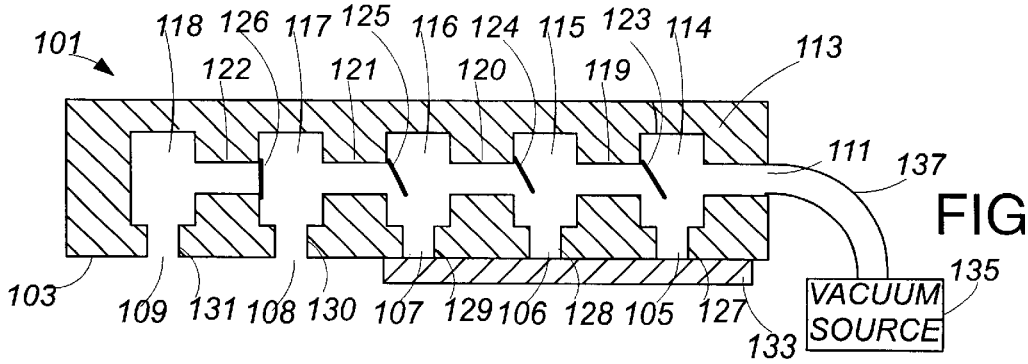

FIGS. 1B–E illustrate the operation of the present invention, with increasing time, to the application of vacuum to port 111. FIG. 1B is at a time prior to and just subsequent to the application of vacuum, FIGS. 1C and 1D show intermediary states, and FIG. 1E is a steady state. The placement of a workpiece 133 is on surface 103 is shown in FIGS. 1B to 1E. The material and surface finish of surface 103 are selected to provide a vacuum seal of each suction opening under the action of suction. Thus any initial leakage of air into a covered suction opening eventually seals off flow through that suction opening, while maintaining suction there.

Workpiece 133 covers suction opening 105 closest to port 111, as well as suction openings 106 to 107 which are adjacent both to suction opening 105 and each other. The plumbing system 113 is configured to limit the application of suction to suction openings 105 to 108 that are either covered by or adjacent to workpiece 133 and have a path through open valves to port 111. The sequential opening of the valves causes suction to be sequentially applied at the openings, and this imparts a suction force on the workpiece that moves along the workpiece as, resulting in an increasing suction force. This aspect of the present invention provides the benefit of limiting stresses on fragile workpieces. Prior to the application of vacuum, valves 123 to 126 are in the closed state shown in FIG. 1B. When vacuum is supplied to port 111, plumbing system 113 adapts to the placement of workpiece 133 by increasing the application of suction to an increasing number of suction openings, one suction opening at a time. The pressure in each chamber 114 to 118 is initially at ambient pressure. The application of vacuum at port 111 evacuates chamber 114, which is substantially sealed by the workpiece at suction opening 105 and the initially closed valve 123. This produces suction only at suction opening 105.

When the pressure in chamber 114 approaches the vacuum pressure, valve 123 transitions to an open setting, as shown in FIG. 1C, and chamber 115 begins to evacuate. The valves are configured to automatically open based on the pressure difference between two adjacent chambers. Workpiece 133 is covering suction opening 106, restricting flow there, while valve 124 is in the initially closed state. Thus suction is supplied to suction openings 105 and 106. The pressure in chamber 115 decreases, eventually reaching a pressure low enough to cause valve 124 to open, as shown in FIG. 1D. At this point suction is supplied to suction openings 105 to 107. Chamber 116, sealed by the initially and still closed valve 125 and workpiece 133 at suction opening 107, then evacuates until the pressure in chamber 116 is low enough to open valve 125, as shown in FIG. 1E. As chamber 117 evacuates, leakage occurs at unsealed suction opening 108. Valve 126 is configured to remained in the closed state when there is leakage at suction opening 108, and so at the sequential opening of valves ceases. Workpiece 133 is held on by the sequential application of suction at suction openings 105, 106 and 107, and the plumbing system need only contend with the vacuum leak at suction opening 108 and any slight leakage that may be occurring at the less-than-perfect vacuum seals at suction openings 105 to 107. The sequential opening of the valves terminates at the opening of valve 125. In a case not shown in the figures, an alternate workpiece also covers suction opening 109 (but as in the above case, not suction opening 108). In this alternate case, no suction force would occur at suction opening 109 since the sequential opening of the valves terminates at the opening of valve 125.

The sequential action of valves 123 to 126, and the resulting application of suction to suction openings 105 to 109, defines a "line of connection" of the vacuum system that is reflected in the sequential application of suction to suction openings along that line, as illustrated in FIGS. 1A–1E. Each valve is in a normally closed state, and is opened by a pressure increase along the line of connection. The various interconnections, bores and valves making up plumbing system 113 are designed so that under the application of a vacuum, pressure drops are larger across bores than across interconnects or valves. On application of a vacuum, all valves 123 to 126 are in a closed state. The sequential evacuation of chambers, and the resulting sequential application of suction to the suction openings associated with each chamber defines the direction of the line of connection.

An important design criteria is that the pressure variations and valve actuations in plumbing system 113 are designed so that the next valve further along the line of connection, valve 126 in FIGS. 1A–1E, remains closed. In other words, the valves are designed to open when all suction openings between the valve and the vacuum source along the line of connection are covered. If one of the suction openings is uncovered, the pressure difference across the valve is too small for the valve to open, and the vacuum is not continued further down the line of connection. By this operation vacuum losses are limited to one suction opening at a time along the line of connection. It is important that the workpiece cover the suction opening closest to the vacuum source for this configuration to operate properly. The invention as presented in FIGS. 1A–1E is illustrative of the method of operation of the present invention, and is not meant to limit this invention to the configuration shown. For example, vacuum surfaces of the present invention may have one or more multiple lines of communication.

Lines of Connection Embodiments

Top views of the support surface 103 of several useful configurations of the present invention are shown in FIGS. 2A–2E. The views in FIGS. 2A–2E are perpendicular to surface 103, and thus are the plan view of a vacuum plate or a view of an unrolled cylindrical vacuum cylinder. Vacuum bores connecting the suction openings to chambers run perpendicular to surface 103, and thus are not visible in these views.

Figure 2A:
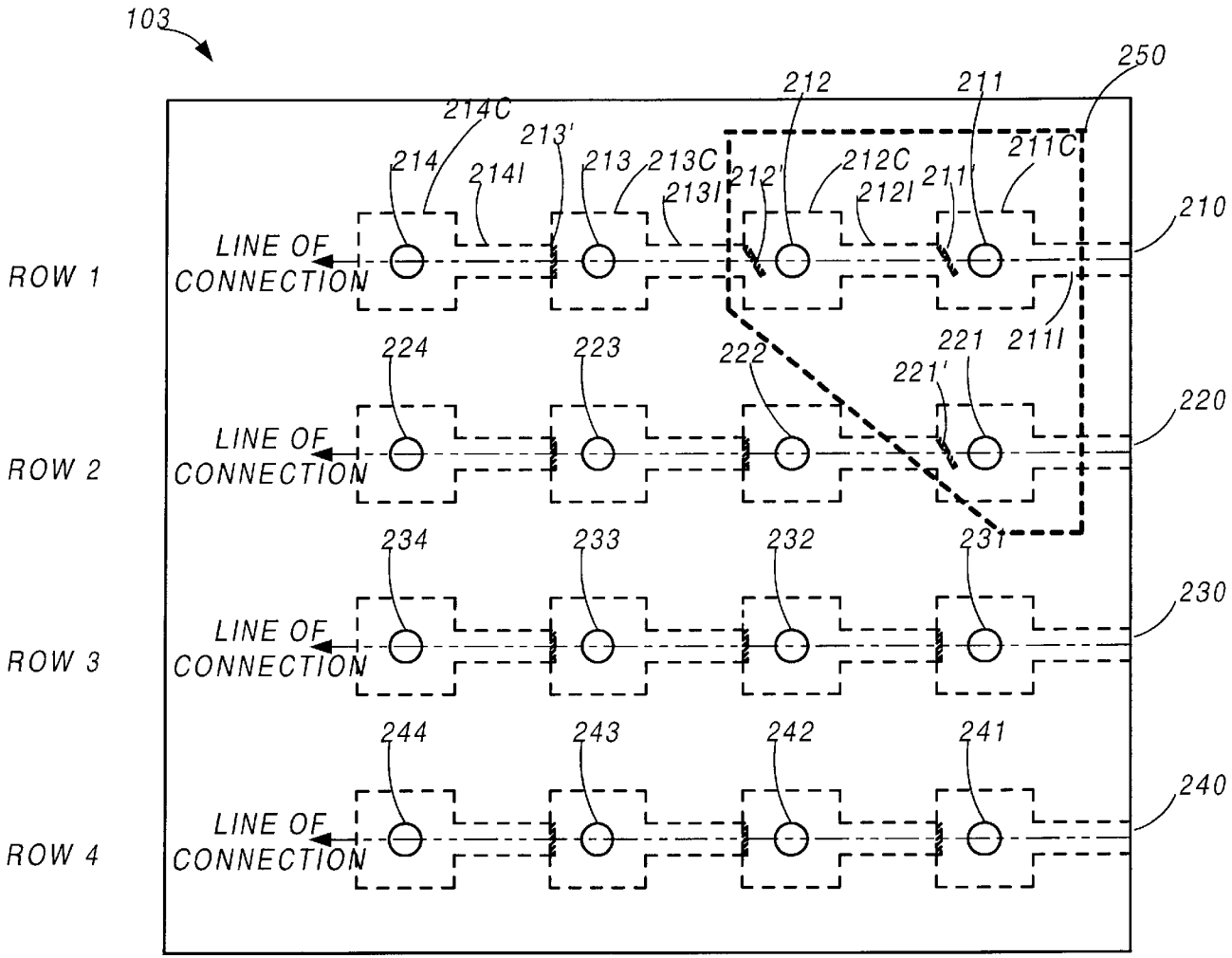
FIG. 2A is a top schematic view of the lines of connection for an embodiment with a rectangular layout of multiple independent rows.

A linear array of lines of connection are shown in FIG. 2A. This configuration has four independent lines of connection, each with four suction openings. Thus the Row 1 Line of Connection runs from a vacuum port 210 through a series of four suction openings 211 to 214. Vacuum port 210 is capable of connection to a vacuum source (not shown). Also shown in FIG. 2A in broken lines are the important sub-surface plumbing components, specifically chambers 211C to 214C, interconnects 211I to 214I, and valves 211' to 213'. The Row 2 Line of Connection runs from a vacuum port 220 through a series of suction openings 221 to 214. This pattern repeats for the Row 3 Line of Connection with a vacuum port 230 and suction openings 231 to 234, and the Row 4 Line of Connection with a vacuum port 240 and suction openings 241 to 244. There is a chamber and interconnect associated with each suction opening, and thus there one valve between each suction opening (or between each set of openings in embodiments that have a set of more than one bores and suction opening for each chamber). Each interconnect and valve combination between two chambers along a line of connection forms a passageway that is controllable to be open or closed. The number of rows, the number of suction openings per row, and the exact layout of the suction opening pattern are for illustrative purposes are not meant to limit the possible embodiments of this invention. The outline of workpiece 250 on surface 103 is shown covering suction openings 211, 212 and 221. Holes 211 and 212 are the first two suction openings in the Row 1 Line of Connection closest to port 210, and suction opening 221 is the first suction opening in the Row 2 Line of Connection closest to port 220. No suction openings in Row 3 or 4 are covered by workpiece 250. The application of vacuum to this system with the workpiece shown will result in suction being applied to all of the suction openings 211, 212, and 221 covered by workpiece 250. Because the valves are designed to open only the next suction opening along each line of connection, leakage of the vacuum system will occur only at the suction openings 213, 222, 231, and 241. Valves 211', 212', and 221' are shown open, their steady state after the vacuum is applied with this workpiece. For this embodiment and workpiece, the vacuum system must only contend with four open suction openings.

This should be contrasted with non-adaptable, prior art systems (not shown) which have non adaptable internal valves, and would thus have thirteen open suction openings (213 to 214, 222 to 224, 231 to 234 and 241 to 233). This also should be contrasted with the Kleinman system of above-mentioned U.S. Pat. No. 5,374,021, wherein each chamber has a valve between the chamber and the suction opening, the valve configured to be normally open, to be closed by application of the vacuum when the associated suction opening is uncovered, and to remain open when the associated suction opening is covered by the workpiece. With the Kleinman arrangement, each chamber is evacuated, requiring a large initial vacuum. Thus all the chambers form a large vacuum chamber which typically is the size of the surface rather than the workpiece, whereas in the present invention, the chambers form a larger chamber that adapts in size according to the dimensions of the workpiece. Furthermore, with the Kleinman system, the workpiece needs to be on the surface prior to application of the vacuum, otherwise those valves not covered by the workpiece will close when the vacuum is applied, resulting in essentially no force on that suction opening. With the present invention, the vacuum may already be on when the workpiece comes in contact with the support surface, providing advantages when picking up objects. Furthermore, with the Kleinman system, a suction force will be imparted simultaneously on all openings covered by the workpiece, whereas suction force is applied sequentially in the various embodiments of the present invention.

Figure 2B:
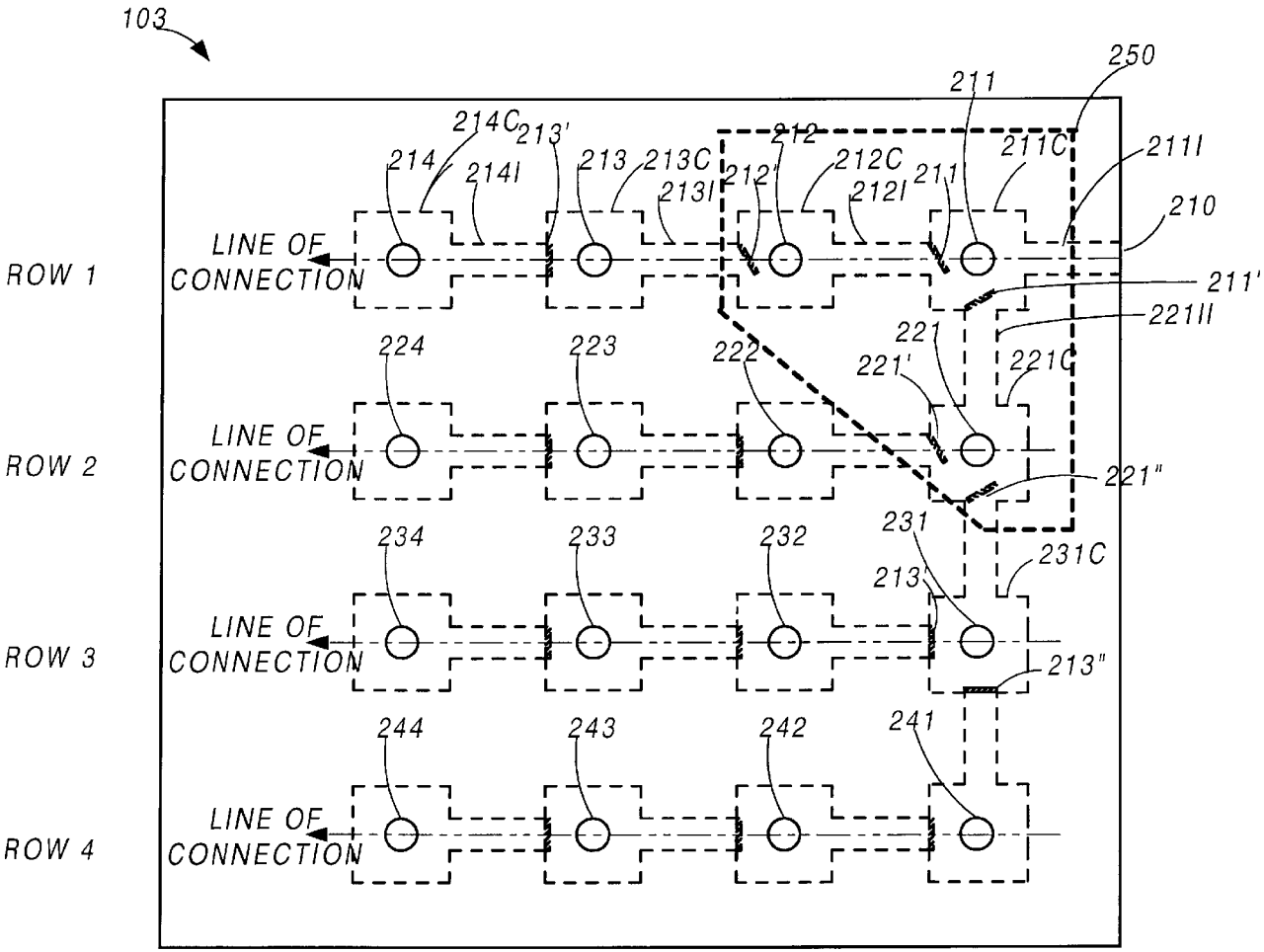
FIG. 2B is a top schematic view of the lines of connection for an embodiment with a rectangular layout of multiply interconnected rows.

A top view of a multiply interconnected line of connection rectangular array is shown in FIG. 2B. This configuration the support surface 103 is shown with one vacuum port 210. Also shown in FIG. 2B in broken lines are the important sub-surface plumbing components, such as chambers, interconnects and valves. The embodiment in FIG. 2B is distinguished over that in FIG. 2A in that some of the chambers are connected to more than one other chamber, leading to bifurcations in the lines of connection. Specifically, chambers 211C, 221C, and 231C, which are associated with suction openings 211, 221, and 231, respectively, are multiply connected. The lines of connection thus bifurcate at suction openings 211, 221, and 231. Chamber 211C is connected through interconnect 212I to chamber 212C by valve 211', and to chamber 221C through interconnect 221II by valve 211". A similar configuration valves chamber 221C to chambers 222C and 231C and also valves chamber 231C to chambers 232C and 241C. As a result of this configuration, the Row 1 Line of Connection runs through openings 211 to 214, the Row 2 Line of Connection runs through the opening sequence 211-221-222-223-224, the Row 3 Line of Connection runs through the opening sequence 211-221-231-232-233-234, and the Row 4 Line of Connection through the opening sequence 211-221-231-241-242-243-244. The multiple valves per chamber work independently of one another, thus suction openings will open sequentially down the lines of connection until an uncovered suction opening is encountered. As a result, uncovered suction openings at bifurcation points will limit the application to suction along both lines of connection emanating from the bifurcation point.

The outline of workpiece 250 on surface 103, covers three suction openings, 211, 212, and 222, providing suction to the workpiece, while only three suction openings 213, 222, and 231 result in leakage to the vacuum system. Valves 211', 211", 221', 221", and 212' are shown open, their steady state after the vacuum is applied with this workpiece. This should be contrasted to the FIG. 2A layout, where the same suction opening pattern and workpiece shape and placement resulting in leakage occurred through four suction openings. The multiple branching down the rightmost suction openings limits the number of rows down which the suction force is applied.

Figure 2C:
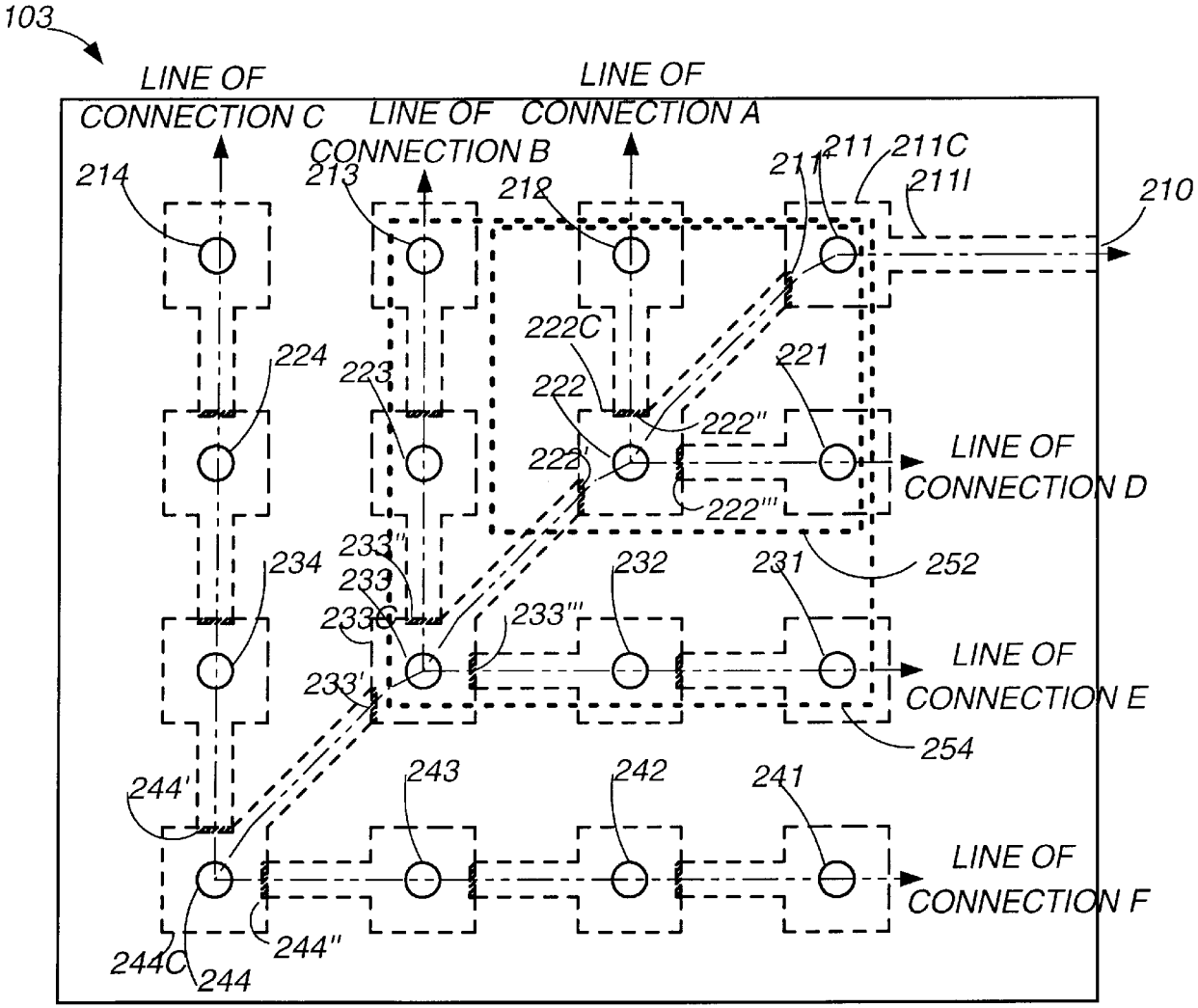
FIG. 2C is a top schematic view of the lines of connection for an embodiment with a rectangular layout of diagonally interconnected rows.

FIG. 2C is a top schematic view of a third embodiment that has a rectangular layout where both rows and columns are diagonally interconnected. Also shown in FIG. 2C in broken lines are the important sub-surface plumbing components, such as chambers, interconnects and valves. The main line of connection runs diagonally from port 210 sequentially through the opening sequence 211-222-233-244. Each of chambers 222C, 233C, and 244C has three valves, trifurcating the lines of connection at those points. Chamber 222C is equipped with valves 222', 222", and 222'", splitting the lines of connection to a Line of Connection A that runs through the opening sequence 211-222-212, a Line of Connection D that runs through opening sequence 211-222-221, and a continuing line that runs diagonally to chamber 233C. Chamber 233C has valves 233', 233", and 233'", trifurcating the line of connection to Line of Connection B, with opening sequence 211-222-233-223-213, Line of Connection E with opening sequence 211-222-233-232-231, and a continuation of the line of connection to chamber 244C. The line further bifurcates at chamber 244C through the multiple valves 244'and 244" into Lines of Connection B and F.

The FIG. 2C embodiment illustrates the usefulness of modifying the lines of connection to expected workpiece shapes. By aligning the lines of connection it is possible to configure the vacuum surface to restrain a large number of difference workpiece shapes with loss of vacuum at only one suction opening. The embodiment of FIG. 2C is particularly useful in minimizing vacuum losses for workpieces 252 or 254 that cover the square suction opening pattern defined by the lines of connection. Thus workpiece 252 is restrained by suction at suction openings 211, 212, 221, and 222, while leakage only occurs at suction opening 233. Workpiece 254 will likewise result in leakage only at suction opening 244.

Figure 2D:
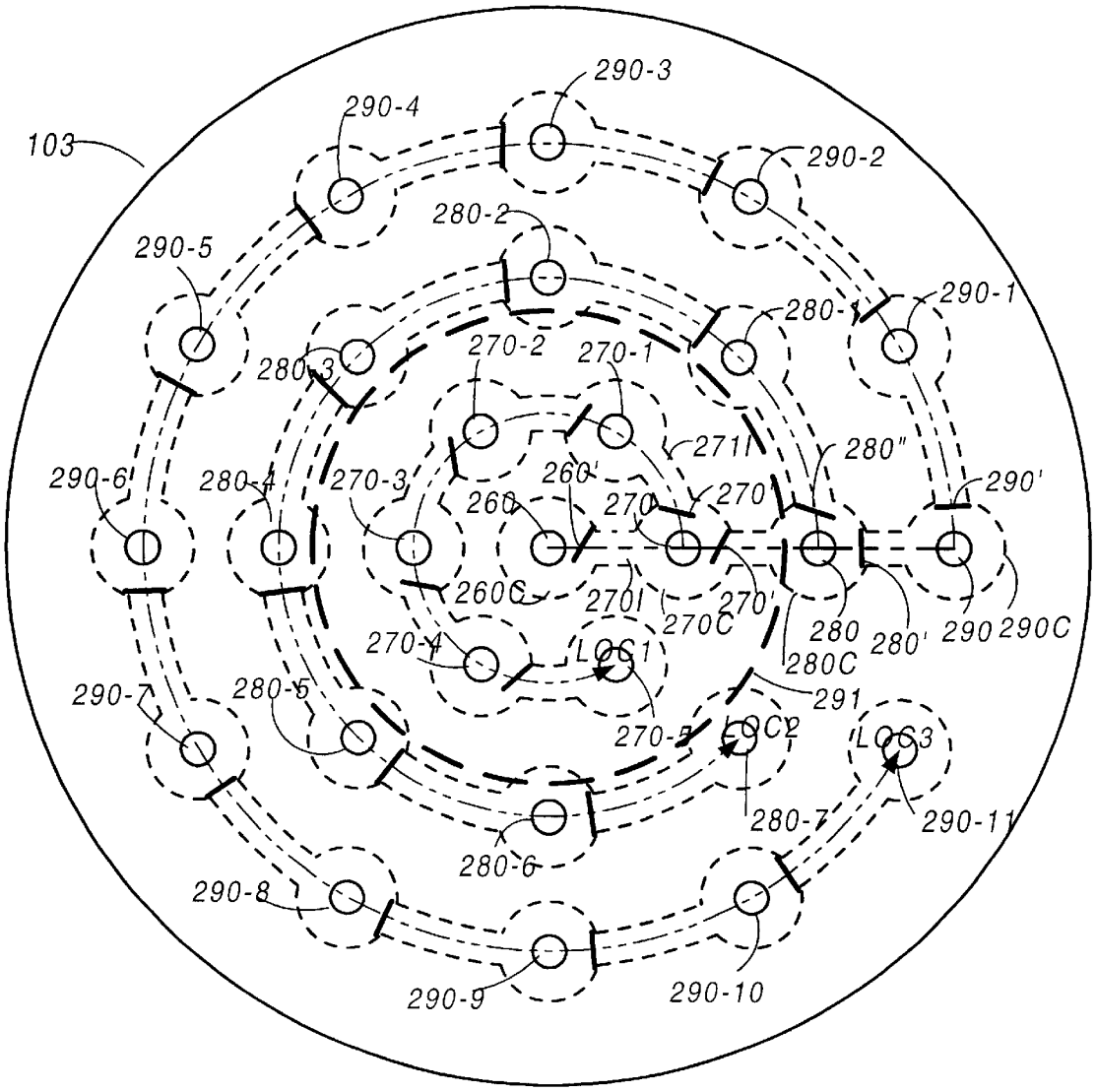
FIG. 2D is a top schematic view of the lines of connection for an embodiment with a circular layout of multiply interconnected radial rows.

The embodiment in FIG. 2D has circular lines of connection pattern. Center suction opening 260, through chamber 260C, is connected to a vacuum port (not shown) at a location below surface 103. Primary suction openings 270, 280, and 290 are connected by vacuum bores (not shown) to chambers 270C, 280C, and 290C, located at a first, second, and third radial location, respectively. The primary suction openings are connected to center suction opening 260 through sub-surface interconnects 260I, 270I, 280I, and 290I, chambers 260C, 270C, 280C, and 290C, and valves 260', 270', 280', and 290'. The suction opening pattern further comprises a set of secondary suction openings 270-1 to 270-5 at the first radial location, a set of secondary suction openings 280-1 to 280-7 at the same second radial location, and a set of secondary suction openings 290-1 to 290-11 at the same third radial location. Chambers 270C and 280C are equipped with two valves each, causing the lines of connection to bifurcate at those points. At each radial location, suction openings are connected thought interconnects, valves, chambers and bores to form circular lines of connection that pass through the primary suction openings. Thus the primary line of connection is through opening sequence 260-270-280-290. The resulting lines of connection 1, 2 and 3 are shown in FIG. 2D. The lines of connections run from suction opening 260 to circular Lines of Connection 1 ("LOC1") at the radii of suction opening 270, circular Line of Connection 2 ("LOC2") at the radii of suction opening 280 and the circular Line of Connection 3 ("LOC3") at the radii of suction opening 290. All other suction openings are connected through a chamber, interconnect and valve to an adjacent suction opening.

A circular workpiece 291 centered on suction opening 260 will result in suction being applied to all suction openings covered by the workpiece, specifically suction opening 260 and all suction openings at the radii of suction opening 270, while leakage will only occur at suction opening 280. This embodiment is thus seen to be particularly useful for restraining circular workpieces centered on the line of connection suction opening pattern.

Figure 2E:
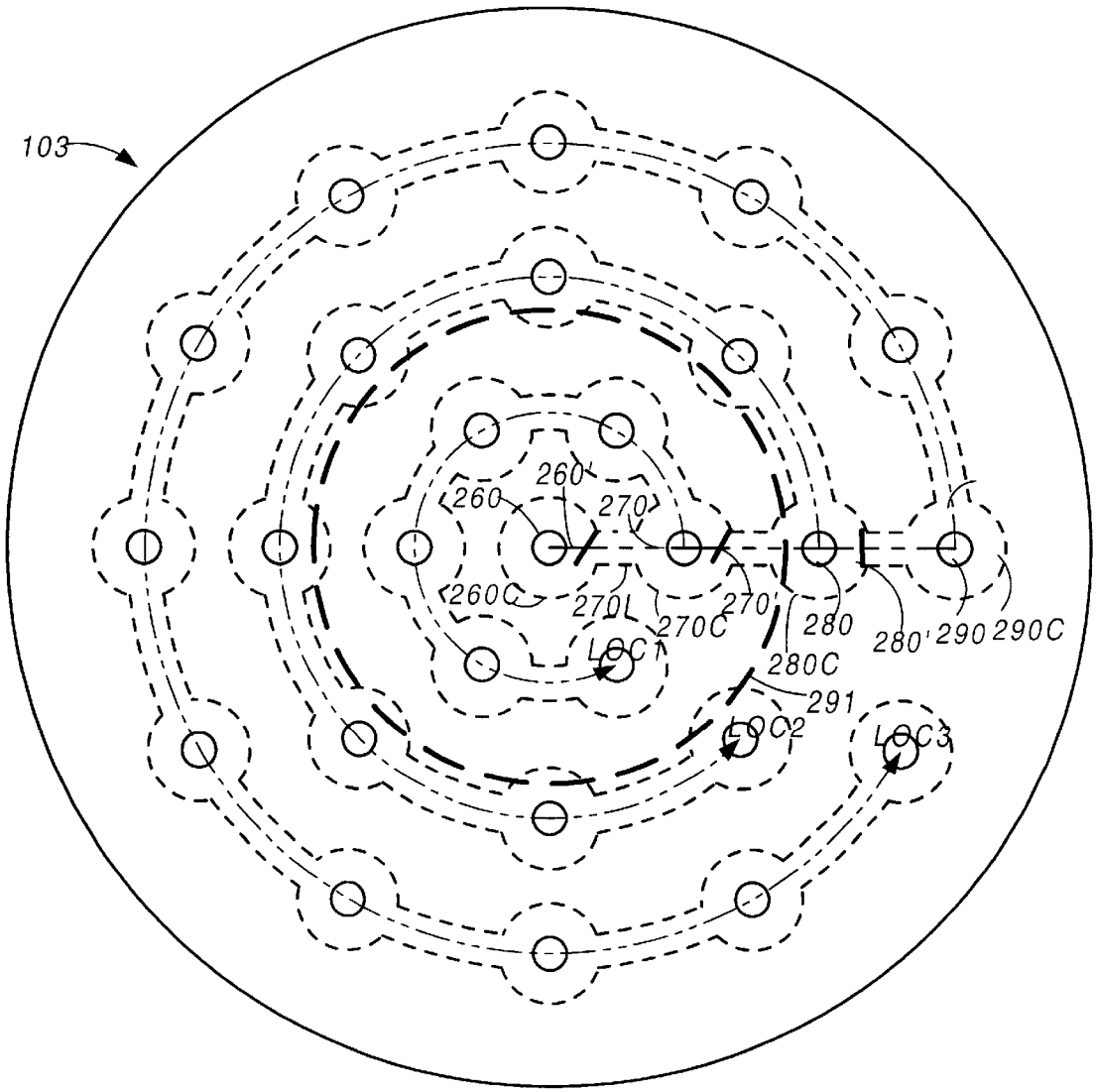
FIG. 2E is a top schematic view of the lines of connection for an embodiment with a circular layout multiple suction openings per connection.

An example of an embodiment with multiple suction openings per valve is presented in FIG. 2E. This embodiment has the same suction opening pattern as the embodiment in FIG. 2D. Holes 260, 270, 280, and 290 are connected though chambers, interconnects, and valves to the next suction opening. All secondary suction openings at each radii are connected without valves, effectively allowing a plurality of suction openings to be controlled with each valve. Thus chamber 270C has 6 suction openings, all of which are activated by valve 260', and chamber 280C has 8 suction openings, all actuated by valve 270'. This configuration has less valves and is thus simpler than previous embodiments. The placement of workpiece 291 will provide suction at suction opening 260 and all suction openings at the radii of suction opening 270. Valve 280' will remain closed, producing a loss of vacuum at all 8 suction openings connected to chamber 280C.

Other planar arrangements also are possible, including, for example, using one or more lines of connection that follow a spiral pattern.

Methods of Assembling Adaptable Vacuum Surfaces

Figure 3A:
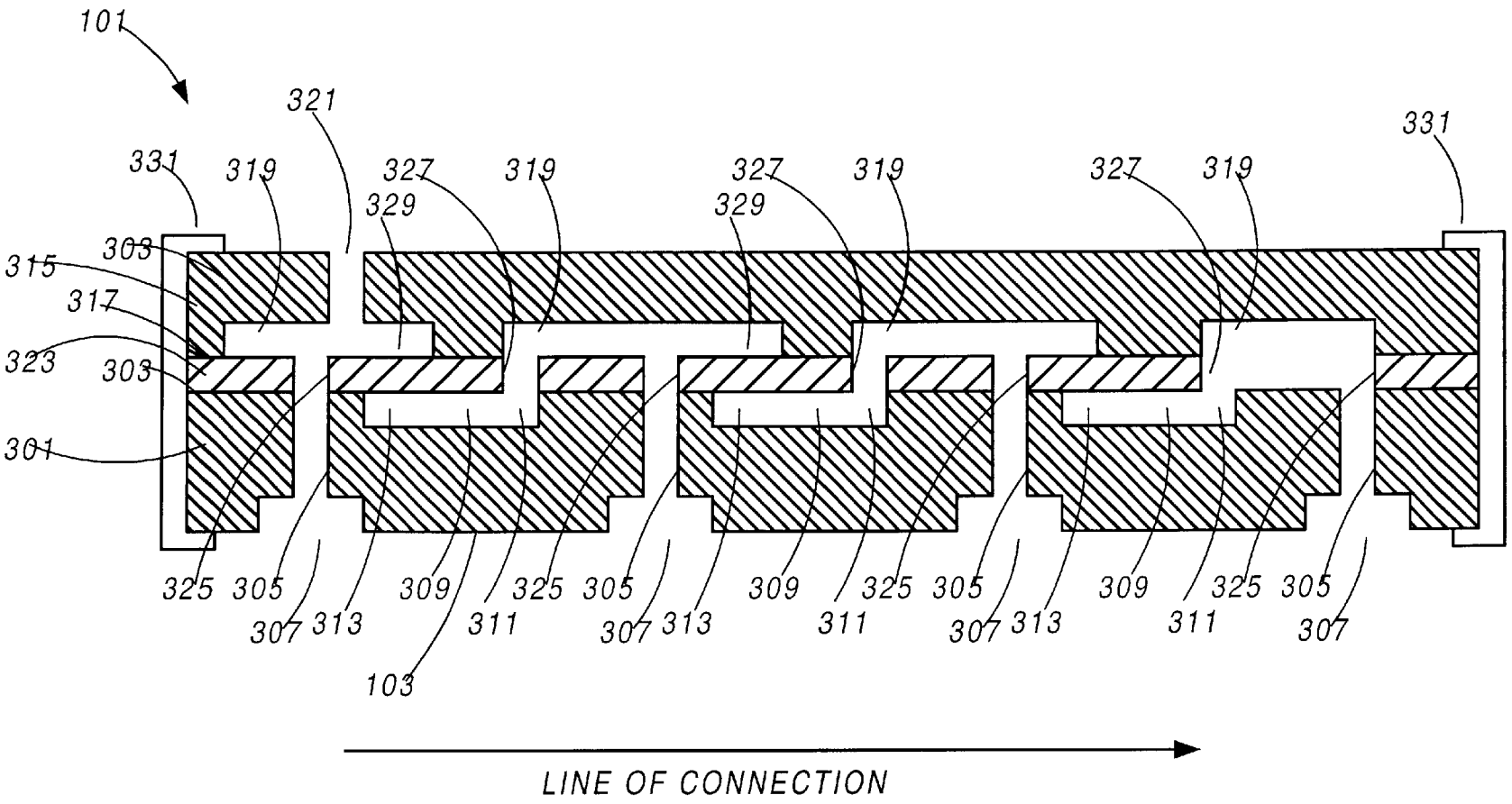
FIG. 3A is a cross-sectional view of the preferred embodiment.
Figure 3B:
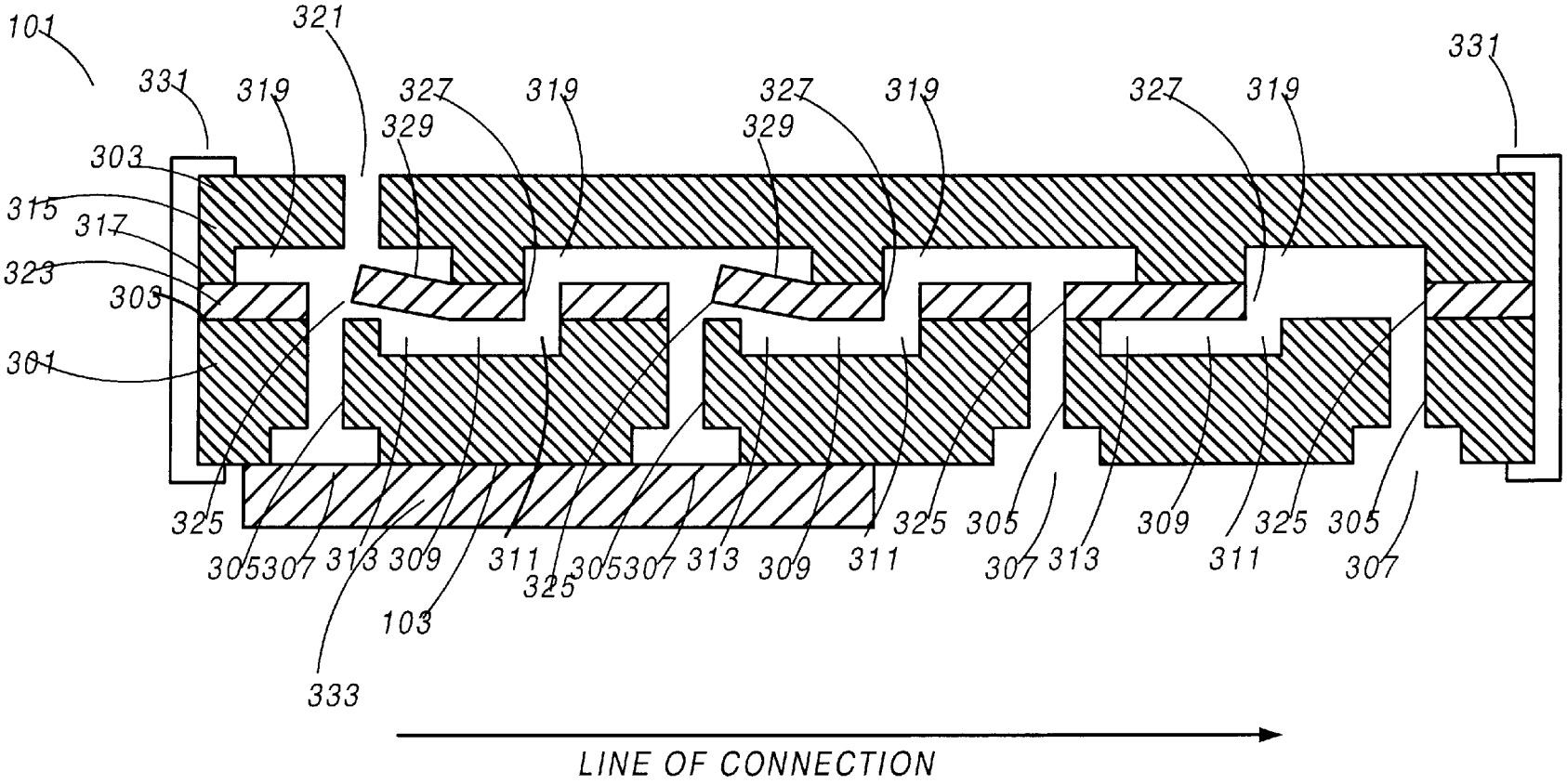
FIG. 3B is a cross-sectional view of the preferred embodiment with a workpiece.
Figure 4:
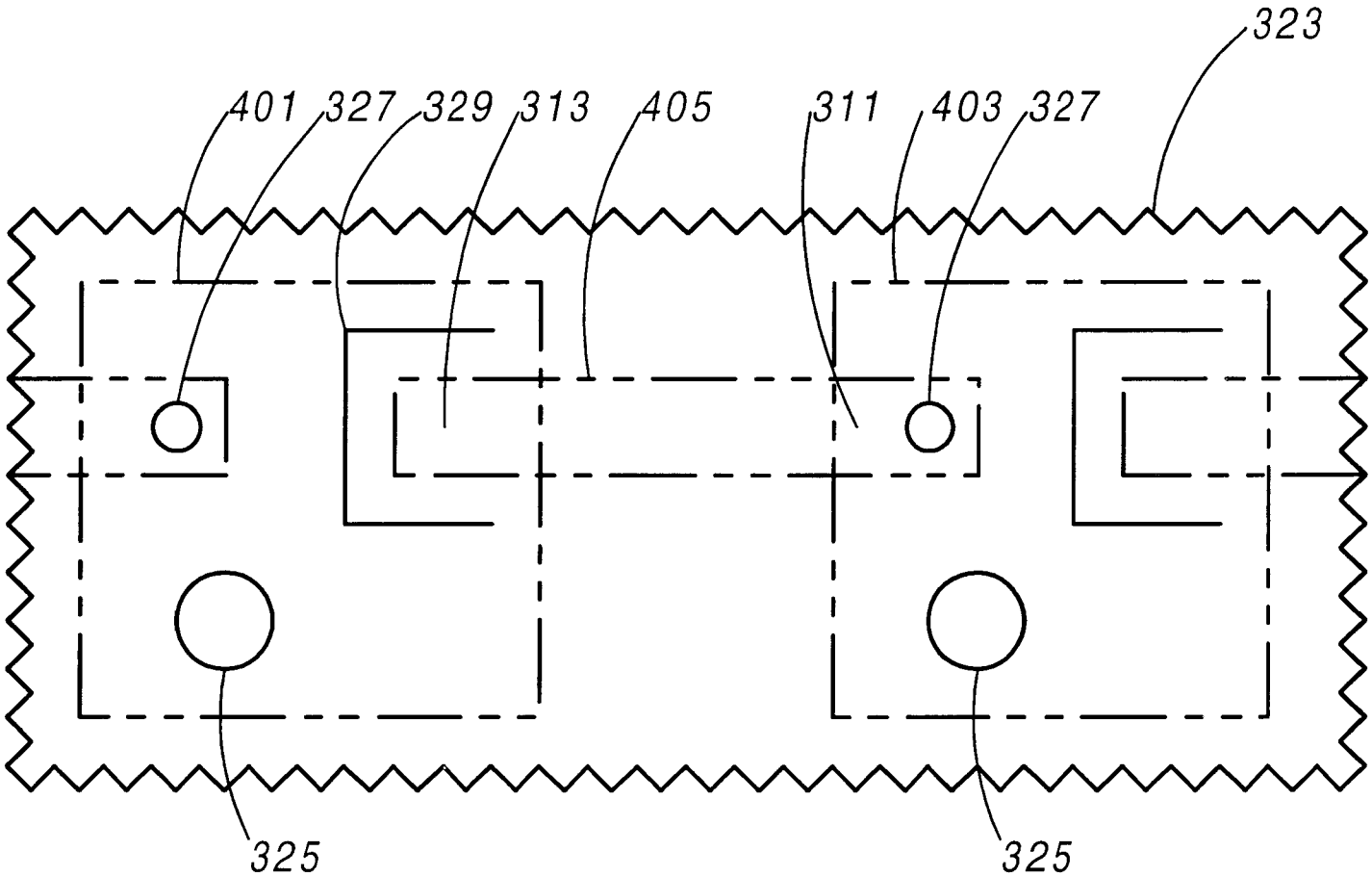
FIG. 4 is a top detailed view of the gasket of the preferred embodiment.

One simple method of constructing an adaptable vacuum surface in accordance with the present invention is shown in FIGS. 3 and 4. The configuration shown in FIGS. 3 and 4 shows an implementation of the singly connected chambers, as illustrated in the embodiments of FIGS. 1 and 2A.

Furthermore, the extension of the construction method outlined here to the multiply connected chambers embodied in FIGS. 2B through 2E is straightforward given the description of the present embodiment.

The present invention is shown in FIG. 3A without a workpiece and in FIG. 3B with a workpiece 333 covering some of the suction openings. The vacuum holder 101 of FIG. 3 includes a workpiece-bearing member 301 (a metal plate, for example), a cover member 315 (e.g., a cover plate), and a resilient gasket 323 sandwiched between workpiece-bearing member 301 and cover member 315 and held in place through a gasket compression mechanism 331. The gasket is made of a single sheet of rubber or other suitable resilient material. The workpiece-bearing member and cover members are preferably made of steel. Compression mechanism 331 can comprise a set of clip springs as shown in FIG. 3, or in other embodiments includes screws (or nuts and bolts) though both members to provide compressive force. The construction is such that mechanism 101 can maintain structural integrity under the force of the vacuum. Workpiece support surface 103, located on the exposed surface of workpiece-bearing member 301, should be materially compatible with the workpiece material, and the application of suction to the suction openings should provide an airtight seal by the workpiece across the suction openings. While polished steel is used in the preferred embodiment, a variety of metallic and plastic materials and coatings on various materials meet these criteria, as would be clear to those in the art.

Cover member 315 is in contact with gasket 323 at a cover member gasket surface 317. Cover member gasket surface 317 has a plurality of chambers 319 formed by cavities in surface 317. At least one of chambers 319 is connected to a vacuum port 321, providing the suction force needed for this invention. One side of workpiece-bearing member 301 has a plurality of suction openings 307 located on surface 103. Each suction opening 307 is connected by a vacuum bore 305 to a workpiece-bearing member gasket surface 303. Each of vacuum bores 305 is aligned both with one of gasket suction openings 325 extending through gasket 323 and one of chambers 319 (in alternate embodiments, a set of openings on the surface is connected to each chamber 319). Connections between chambers are made by a plurality of channels 309 formed by cavities in the workpiece-bearing member gasket surface 303. Channels 309 are aligned to overlap the edges of adjacent chambers 319. One end of each channel, the open channel end 311, is connected to a chamber 319 through gasket channel suction openings 327. The opposite, valved channel end 313, is connected to an adjacent chamber 319 by a gasket flap 329 in gasket 323 that defines a valve. Gasket flap 329 is formed through a partially cut-out section of gasket 323 that in its closed state covers the entire valved channel end 313, and in its open state folds into chamber 319 given a sufficient over-pressure in channel 309 relative the pressure in chamber 319. Gasket flaps 329 thus each define a valve biased to be closed, and allowing, when open, air to be suctioned through connected chambers towards vacuum port 321.

A top view of a section of gasket 323 that services two adjacent chambers 319 is shown in FIG. 4. The location of the edges of chambers 319 are shown as chamber edges 401 and 403. There is gasket suction opening 325 located within each chamber edge. The location of the edge of the channel 309 that connects the two chambers is shown as channel edge 405. Note that chamber edges 401 and 403 and channel edge 405 are on the opposite sides of gasket 323. Edge 401 in this view is located closer to vacuum port 321 (not shown) than is edge 403. The channel end closest to vacuum port 321 is the valved channel end 313, located within chamber edge 401, while the channel end farthest from port 321 is the open channel end 331 and is located within chamber edge 403. A gasket channel suction opening 327 is located within chamber edge 403 forming the open channel connection. Gasket flap 329 is positioned to cover valved channel end 313 when in the closed state, and to also be included in chamber edge 401 so that the flap can open into the chamber providing a path for communication between chambers.

The cavities, suction openings and flaps in members 301 and 315 and gasket 305 can perform the functions described previously regarding the action of the mechanism shown in FIGS. 1 and 2. The action of the valves to a workpiece 333 is shown in FIG. 3B When a vacuum is applied to port 321, valves along the line of communication, traveling away from port 321 are sequentially opened. Valves 329 open into chambers 319 providing a passage of ambient air through suction openings 307 towards port 321. The embodiment presented here can be modified to include multiple channels per suction opening, allowing for multiple lines of connection, and can likewise be configured without gasket flaps between selected chambers to allow the mechanism to have multiple suction openings per valve. These combinations will allow for any of the embodiments presented in FIG. 2.

Figure 5A:
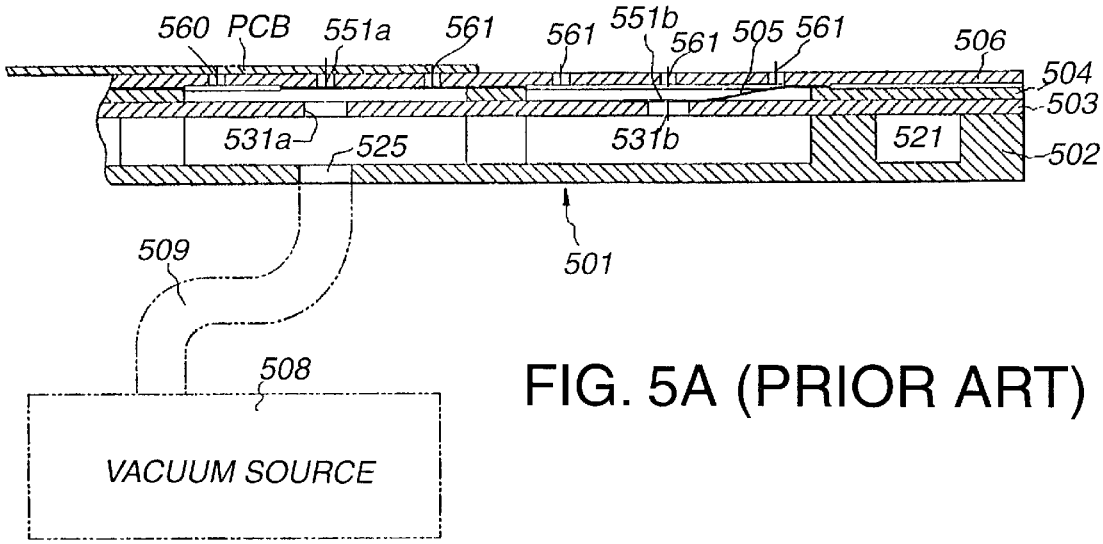
FIG. 5A (PRIOR ART)
FIG. 5A is a longitudinal sectional view of a prior art vacuum table.
Figure 5B:
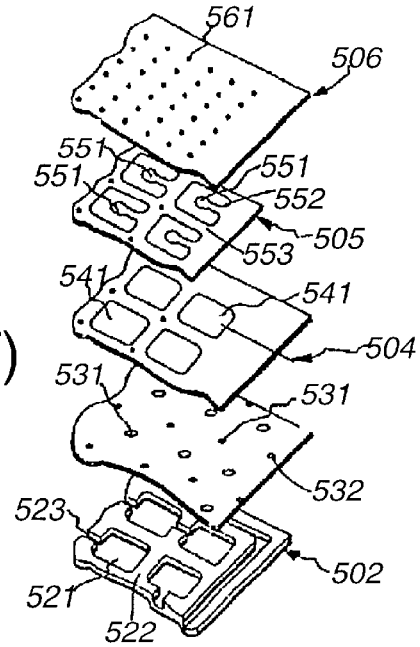
FIG. 5B (PRIOR ART)
FIG. 5B is a fragmentary, exploded view of the vacuum table of FIG. 5A.

It is interesting to contrast the embodiment of FIGS. 3 and 4 with an embodiment of the Kleinman system described in above-mentioned U.S. Pat. No. 5,374,021 and shown in FIG. 5. FIG. 5A is a longitudinal sectional view of vacuum table 501, and FIG. 5B is a fragmentary, exploded view of the vacuum table of FIG. 5A. Vacuum table 501 has a rigid base member 502; a partition member 503 thereover; a spacer member 504 thereover; a sheet 505 thereover defining a plurality of valve members; and an upper panel 506 formed with a plurality of suction openings (561) and adapted to receive and hold a workpiece (e.g., a printed circuit board PCB) thereon. The vacuum table 501 is adapted to be connected to a vacuum source 508 via a vacuum tube 509. The rigid base member 502 is formed with a plurality of upwardly-facing cavities 521, each circumscribed by a wall 522 formed with a slot 523 such that the cavities 521 are always interconnecting. Base member 502 is further formed with an opening 525 connected by vacuum tube 509 to the vacuum source 508. The partition member 503 with the cavities 521 of base member 502 thus form a plurality of vacuum sub-chambers interconnected by slots 523. The partition member 503 has an opening 531 for each of the vacuum sub-chambers 521. The smaller openings 532 are to assist in adhesively bonding the partition member to the rigid base 502 and to the overlying spacer member 504.

Spacer member 504 is also in the form of a sheet. It has a plurality of cut-outs 541 of the same configuration as, and aligned with, one of the vacuum sub-chamber cavities 521 formed in the rigid base member 502. Thus, control passageway openings 531 are formed in the partition member 503 and are each located centrally of one of the vacuum sub-chamber cavities 521, and centrally of one of the cut-outs 541 in the spacer sheet 504 on the opposite side.

The valve member sheet 505 overlying the spacer member 504 is formed with a plurality of valve members 551 for, and aligned with, each of the control passageway openings 531 formed in the partition member 503. Each of the valve members by valve member 551*a*, 551*b*, 551 is of planar configuration, and is integrally formed with an elastic juncture section 552, and a common outer frame 553, which serves as a mounting section for all the valve members.

The upper panel 6 included in the vacuum table is formed with the plurality of suction openings 561 through which suction is applied for holding the article PCB on the table.

The valve members 551, in their normal unstressed condition, are substantially coplanar with their common frame 553; that is, their juncture sections 552 are not bent. Thus, the valve members 551 are normally biased to the position illustrated by valve member 551*a* in FIG. 5A, opening its respective connecting passageway 531*a*. When the vacuum source 508 is applied to the interconnecting sub-chambers, the vacuum will apply a force displacing the valve members 551 towards their respective connecting passageways 531 to close those passageways, as illustrated by valve member 551*b* closing passageway 531*b* in FIG. 5A. This displacement of the valve members 551 will occur only with respect to all the connecting passageways communicating with suction openings 561 not covered by the article PCB on the table. Thus, those suction openings 561 not covered by the printed circuit board PCB will have no vacuum applied. However, the suction openings 561 covered by the printed circuit board will remain in communication with their respective connecting passageway. Accordingly, the vacuum from the respective sub-chamber cavity 521 will be applied via connecting passageway 531 to the suction openings 561 communicating with that connecting passageway via the outlet chamber defined by the cut-out 541 in spacer member 504, thereby firmly holding the workpiece PCB to the table.

As previously pointed out, the Kleinman system has several shortcomings in comparison with the present invention. In addition, the construction of the Kleinman system shown in FIG. 5 is more complex than the construction of the embodiment of the present invention shown in FIGS. 3 and 4. More layers are involved, these need to be accurately aligned, and the having a normally open valve made with a movable flap of a resilient material closing a hole on another material is more prone to problems than having a normally closed valve defined by a cut on a resilient sheet. Thus, the Kleinman construction shown in FIG. 5 is more difficult to construct, liable to be more expensive, and liable to be more problematic.

Several variations of the present invention are possible. Several suction openings may be used for each chamber. Also, surface patterns such as cross-grooves on the surface may be used to improve the suction force and contact, as is known in the art. For example, the suction openings may end on the workpiece support surface in a grooved pattern to optimize suction force towards the workpiece being held. Such improvements are within the scope of the invention. The inventive automatically adapting vacuum system described herein thus can be applied to any type of suction opening and surface structure, and how to modify the embodiments described herein to incorporate such features would be clear to those in the art.

Hence, although this invention has been described with respect to preferred embodiments, those embodiments are illustrative only. No limitation with respect to the preferred embodiments is intended or should be inferred. It will be observed that numerous variations and modifications may be effected without departing from the true spirit and scope of the novel concept of the invention, and it is intended that the scope of the invention be defined by the claims appended hereto.

What is claimed is:

1. An automatically adapting vacuum holder for holding a workpiece by suction by the application of a vacuum from a vacuum source, the vacuum holder comprising:

(a) a workpiece-bearing member having a workpiece support surface adapted for supporting the workpiece thereon, and (b) a vacuum plumbing system connectable to the vacuum source through a set of at least one vacuum ports, the plumbing system including:

(i) a plurality of chambers positioned along one or more directed lines of connection, each line of connection including one of said plurality of chambers directly coupled to and emanating from one of the set of vacuum ports, (ii) a plurality of passageways positioned between any two chambers along any one of said lines of connection for controllably connecting each chamber along a line of connection to the next chamber further from the vacuum source along the line of connection, each of the passageways having a connected state and a disconnected state substantially connecting and substantially not connecting, respectively, the two chambers on either side thereof, and (iii) a plurality of vacuum bores each extending from the workpiece support surface of the workpiece-bearing member to a corresponding chamber to define a suction opening on the support surface and configured to be substantially covered when the workpiece is placed thereon, each chamber either directly connectable to the vacuum source or capable of being connected to the vacuum source via the passageways along one of the directed lines of connection, each of the passageways from any particular chamber to the next chamber along any of the particular chamber's directed lines of connection being:

biased to be in the disconnected state to the next chamber along any of the particular chamber's lines of connection when the vacuum is not applied, configured to remain in the disconnected state to the next chamber along any of the particular chamber's lines of connection if the suction opening of each of the vacuum bores of the particular chamber is not covered by the workpiece, and configured to be in the connect state to the next chamber along any of the particular chamber's lines of connection when the vacuum plumbing system is connected to the vacuum source and the vacuum is applied and when the workpiece is placed on the surface so that the workpiece substantially covers the one or more suction openings of the particular chamber and all the suction openings of the chambers closer to the vacuum source along any of the particular chamber's line of connection, such that the vacuum holder automatically adapts to the size of the workpiece by automatically limiting the number of uncovered suction openings to which the vacuum source is coupled when the vacuum source is connected to the vacuum plumbing system and the vacuum is applied.

2. The vacuum holder according to claim 1, wherein the automatic adapting is by the suction openings sequentially opening along the directed lines of connection, the sequential opening completion according to the size of the workpiece, such that the amount of vacuum necessary to restrain the workpiece is automatically regulated.

3. The vacuum holder according to claim 1, wherein the workpiece support surface is planar.

4. The vacuum holder according to claim 1, wherein the workpiece support surface is cylindrical.

5. The vacuum holder according to claim 1, wherein there are three or more passageways per chamber.

6. The vacuum holder according to claim 1, wherein the suction opening ends on the surface in a grooved pattern to optimize suction force towards the workpiece.

7. The vacuum holder according to claim 3, wherein the lines of connection are arranged along a polar grid.

8. The vacuum holder according to claim 3, wherein the lines of connection are arranged along a spiral.

9. The vacuum holder according to claim 3, wherein the lines of connection are arranged along a Cartesian grid.

10. The vacuum holder according to claim 4, wherein the lines of connection are arranged along a Cartesian grid.

11. The vacuum holder according to claim 1, wherein the passageways include a channel and a valve.

12. The vacuum holder according to claim 11, further comprising a cover member and a resilient gasket located between the cover member and the workpiece-bearing member in contact with a cover member gasket surface and a workpiece-bearing member gasket surface, respectively, of the cover and workpiece-bearing members, respectively, the chambers being formed by cavities in the cover member, the gasket defining the valves, and the channels formed by cavities along the workpiece-bearing member gasket surface of the workpiece-bearing member.

13. The vacuum holder according to claim 12, wherein flaps in the gasket define the valves.

14. The vacuum holder according to claim 1, wherein the automatic adapting is by the suction openings sequentially opening along the directed lines of connection, the sequential opening completion according to the size of the workpiece.

15. The vacuum holder according to claim 1, wherein along any directed line of connection, when the vacuum plumbing system is connected to the vacuum source, the vacuum is applied, and the steady state is reached with workpiece on the surface, the vacuum source is coupled to each chamber along the directed line of connection whose one or more suction openings are covered by the workpiece and to the first chamber of the directed line of connection along the direction away from the vacuum source that has at least one suction opening uncovered by the workpiece, and the vacuum source is not coupled to the other chambers with an uncovered suction opening along the directed line of connection.

16. The vacuum holder according to claim 1, wherein the automatic adaptation to the size of the workpiece automatically limits the number of chambers to which the vacuum source is coupled when the vacuum source is connected to the vacuum plumbing system and the vacuum is applied.

17. An automatically adapting vacuum holder for supporting a workpiece through the application of a vacuum from a vacuum source, the vacuum holder comprising:

(a) a workpiece-bearing member with a workpiece support surface and a workpiece-bearing member gasket surface, the workpiece-bearing member including:

(i) a plurality of vacuum bores extending from the workpiece support surface to the workpiece-bearing member gasket surface and defining suction openings on the workpiece support surface and the workpiece-bearing member gasket surface, and (ii) a plurality of channels formed by cavities in the workpiece-bearing member gasket surface, each channel located between two suction openings and having an open channel end and a valved channel end, (b) a cover member with a cover member gasket surface and a plurality of chambers formed by cavities in the cover member gasket surface and at least one vacuum port capable of connecting at least one of the chambers to the vacuum source, (c) a gasket positioned between the workpiece-bearing member gasket surface and cover member gasket surface, the gasket including a plurality of gasket suction openings extending through the gasket and aligned to connect each vacuum bore with one of said plurality of chambers, and a plurality of gasket channel suction openings extending through the gasket and aligned to connect each open channel end with one of said plurality of chambers, and a plurality of gasket flaps formed by incisions in the gasket where each of the gasket flaps is aligned between each valved channel end and one of said plurality of chambers different from that at the open channel end, the gasket flaps adapted to be either in a connected state wherein the flap folds into the chamber, thereby connecting adjacent chambers, or to be in a disconnected state wherein the flap seals against the valved channel end, thereby disconnecting adjacent chambers, and (d) a gasket compression mechanism to force the workpiece-bearing member gasket surface and cover member gasket surface against the gasket forming a vacuum-tight seal about the channels, chambers, and vacuum bores, such that the placement of the workpiece on the workpiece support surface that is capable of forming a vacuum-tight seal under an imposed vacuum source will result in adjacent chambers to be sequentially connected to the vacuum source until the suction openings near the edge of the workpiece are connected, automatically adapting the application of vacuum to the size of the workpiece by limiting the application of vacuum primarily to suction openings covered by the workpiece.

18. The vacuum holder according to claim 17, wherein the workpiece support surface is planar.

19. The vacuum holder according to claim 18, wherein the suction openings are arranged along a polar grid.

20. The vacuum holder according to claim 18, wherein the suction openings are arranged along a Cartesian grid.

21. The vacuum holder according to claim 17, wherein the workpiece support surface is cylindrical.

22. The vacuum holder according to claim 21, wherein the suction openings are arranged along a Cartesian grid.

23. The vacuum holder according to claim 17, wherein there are three or more channels connected to a particular chamber.

24. The vacuum holder according to claim 17, wherein the suction opening ends on the surface in a grooved pattern to optimize suction force towards the media.

25. An automatically adapting vacuum holder for holding a workpiece by suction, comprising:

(a) a housing having a plurality of internal chambers connectable to a source of vacuum and mutually connectable along a line of connection, the housing including an workpiece support surface contactable by the workpiece to be held, and formed with a suction opening leading via a vacuum bore to the vacuum chamber, each line of connection being connectable to the source of vacuum at one end; and (b) a passageway positioned between any adjacent pair of chambers along the same line of connection, the passageway controllably connecting the chamber of the pair closer than the other to the source of vacuum along a line of connection to the next chamber further from the source of vacuum along the line of connection, the passageway having a connected state substantially connecting the pair of chambers and a disconnected state substantially not connecting the pair, the passageway biased to be in the disconnected state; and (c) a set of one or more vacuum bores extending from each chamber to the support surface to define a set of one or more suction openings on the surface and configured to be substantially covered when a workpiece is placed thereon;

each passageways configured to be in the connected state when the vacuum is applied and the suction openings of the closer chamber of the pair and of all chambers along the line of connection closer to the source of vacuum than the pair are covered by the workpiece, such that a vacuum chamber is formed by those chambers whose suction openings are covered by the workpiece, the size the vacuum chamber automatically adapting to the size of the workpiece on the support surface.

26. An automatically adapting vacuum holder for holding a workpiece by suction by the application of a vacuum from a vacuum source, the vacuum holder comprising:

(a) a workpiece-bearing member having a workpiece support surface adapted for supporting the workpiece thereon, and (b) a vacuum plumbing system connectable to the vacuum source through a set of at least one vacuum ports, the plumbing system including:

(i) a plurality of chambers positioned along one or more directed lines of connection, each line of connection including one of said plurality of chambers directly coupled to and emanating from one of the set of vacuum ports, (ii) a plurality of passageways positioned between any two chambers along any one of said lines of connection for controllably connecting each chamber along a line of connection to the next chamber further from the vacuum source along the line of connection, each of the passageways having a connected state and a disconnected state substantially connecting and substantially not connecting, respectively, the two chambers on either side thereof, and (iii) a plurality of vacuum bores each extending from the workpiece support surface of the surface workpiece-bearing member to a chamber to define a suction opening on the support surface and configured to be substantially covered when the workpiece is placed thereon, each chamber having one or more corresponding bores, each chamber either directly connectable to the vacuum source or capable of being connected to the vacuum source via the passageways along one of the directed lines of connection from the vacuum source, each of the passageways from any particular chamber to the next chamber along any of the particular chamber's directed lines of connection being:

biased to be in the disconnected state to the next chamber along any of the particular chamber's lines of connection when the vacuum is not applied, configured to remain in the disconnected state to the next chamber along any of the particular chamber's lines of connection if the suction opening of each of the one or more vacuum bores of the particular chamber is not covered by the workpiece, and configured to be in the connect state to the next chamber along any of the particular chamber's lines of connection when the vacuum plumbing system is connected to the vacuum source and the vacuum is applied and when the workpiece is placed on the surface so that the workpiece substantially covers the one or more suction openings of the particular chamber and all the suction openings of the chambers closer to the vacuum source along any of the particular chamber's line of connection, such that the vacuum holder automatically adapts to the size of the workpiece by automatically limiting the number of chambers to which the vacuum source is coupled when the vacuum source is connected to the vacuum plumbing system and the vacuum is applied.

27. An automatically adapting vacuum holder for holding a workpiece, the vacuum holder comprising:

(a) a workpiece-bearing member having a workpiece support surface adapted for supporting the workpiece thereon, and (b) a vacuum source for applying a vacuum;

(b) a vacuum plumbing system connected to the vacuum source through a set of at least one vacuum ports, the plumbing system including:

(i) a plurality of chambers positioned along one or more directed lines of connection, each line of connection including a one of said plurality of chambers directly coupled to and emanating from one of the set of vacuum ports, (ii) a plurality of passageways positioned between any two chambers along any one of said lines of connection for controllably connecting each chamber along a line of connection to the next chamber further from the vacuum source along the line of connection, each of the passageways having a connected state and a disconnected state substantially connecting and substantially not connecting, respectively, the two chambers on either side thereof, and (iii) a plurality of vacuum bores each extending from the workpiece support surface of the surface workpiece-bearing member to a chamber to define a suction opening on the support surface and configured to be substantially covered when the workpiece is placed thereon, each chamber having one or more corresponding bores, each chamber either directly connected to the vacuum source or capable of being connected to the vacuum source via the passageways along one of the directed lines of connection from the vacuum source, each of the passageways from any particular chamber to the next chamber along any of the particular chamber's directed lines of connection being:

biased to be in the disconnected state to the next chamber along any of the particular chamber's lines of connection when the vacuum is not applied, configured to remain in the disconnected state to the next chamber along any of the particular chamber's lines of connection if the suction opening of each of the one or more vacuum bores of the particular chamber is not covered by the workpiece, and configured to be in the connect state to the next chamber along any of the particular chamber's lines of connection when the vacuum plumbing system is connected to the vacuum source and the vacuum is applied and when the workpiece is placed on the surface so that the workpiece substantially covers the one or more suction openings of the particular chamber and all the suction openings of the chambers closer to the vacuum source along any of the particular chamber's line of connection, such that the vacuum holder automatically adapts to the size of the workpiece by automatically limiting the number of chambers to which the vacuum source is coupled when the vacuum is applied.

* * * * *